US007234604B2

(12) United States Patent
Eisele

(10) Patent No.: US 7,234,604 B2
(45) Date of Patent: Jun. 26, 2007

(54) SYSTEMS AND METHODS FOR DISPLAYING ARTICLES

(75) Inventor: Darrin S. Eisele, Sedalia, CO (US)

(73) Assignee: McLane Company Inc., Temple, TX (US)

( * ) Notice: Subject to any disclaimer, the term of this patent is extended or adjusted under 35 U.S.C. 154(b) by 332 days.

(21) Appl. No.: 10/843,883

(22) Filed: May 12, 2004

(65) Prior Publication Data

US 2005/0252872 A1 Nov. 17, 2005

(51) Int. Cl.
*A47B 43/00* (2006.01)

(52) U.S. Cl. ..... 211/187; 211/190; 108/65

(58) Field of Classification Search ..... 211/187, 211/106.01, 106, 80.02, 90.01, 190, 134, 211/189; 108/65, 83, 109, 193
See application file for complete search history.

(56) References Cited

U.S. PATENT DOCUMENTS

| | | | | |
|---|---|---|---|---|
| 1,235,225 | A | 7/1917 | Miller | |
| 2,167,375 | A | 7/1939 | Rubenstein | |
| 2,289,042 | A | 7/1942 | Robertson | |
| 2,698,690 | A | 1/1955 | Rubenstein | |
| 2,738,075 | A | 3/1956 | Guignard et al. | |
| 2,897,975 | A | 8/1959 | Rubenstein | |
| 2,972,416 | A | 2/1961 | De Vivo | |
| 3,115,252 | A | 12/1963 | Senical | |
| 3,223,247 | A | 12/1965 | Bleed | |
| 4,498,592 | A | 2/1985 | Colucci | |
| 4,718,562 | A | 1/1988 | Winkler, Jr. | |
| 5,090,579 | A | 2/1992 | Major | |
| 5,149,039 | A | 9/1992 | Perterson et al. | |
| 5,184,737 | A | 2/1993 | Hardy | |
| 5,221,014 | A | 6/1993 | Welch et al. | |
| 5,415,302 | A | 5/1995 | Carlson et al. | |
| 5,433,327 | A | 7/1995 | Benvenuti | |
| 5,439,122 | A | 8/1995 | Ramsay | |
| 5,466,057 | A | 11/1995 | Blankenburg | |
| D373,913 | S | 9/1996 | Wyatt et al. | |
| 5,573,124 | A | 11/1996 | Frost | |
| 5,579,927 | A | 12/1996 | Thompson et al. | |
| 5,632,387 | A | 5/1997 | Johnson | |
| 5,769,247 | A | 6/1998 | Meri | |
| 5,897,005 | A | 4/1999 | Bernens et al. | |
| 5,924,663 | A | 7/1999 | Gatto | |
| 5,971,174 | A | 10/1999 | Strock | |
| 5,988,410 | A | 11/1999 | Mandle | |
| 6,036,311 | A | 3/2000 | Friedman | |
| 6,062,402 | A | 5/2000 | Ford | |
| 6,129,431 | A | 10/2000 | Hansen, Jr. et al. | |
| 6,132,158 | A * | 10/2000 | Pfeiffer et al. | 414/276 |
| 6,138,583 | A | 10/2000 | Mahone et al. | |
| 6,257,426 | B1 * | 7/2001 | Masunaka et al. | 211/187 |
| 6,260,488 | B1 | 7/2001 | Yang et al. | |
| 6,302,369 | B1 | 10/2001 | Liebers et al. | |

(Continued)

*Primary Examiner*—Jennifer E. Novosad
(74) *Attorney, Agent, or Firm*—Baker Botts L.L.P.

(57) ABSTRACT

A configurable display rack and rack kits include one or more rack systems, shelves, and/or hangers. In one particular embodiment, the rack systems include display structures mounted to bases. A display structure is formed with a mesh backing in an inner area defined by an outer perimeter of the display structure. This mesh backing can be capable of supporting hangers, and shelving slots distributed around the perimeter of the display structure is capable of supporting bracketed shelves. In particular instances, the mesh backing is removable from the display structures.

4 Claims, 12 Drawing Sheets

U.S. PATENT DOCUMENTS 6,364,138 B1 * 4/2002 Chen ..... 211/187
6,527,128 B1 3/2003 Samaria
6,612,448 B2 9/2003 Plutsky
6,634,511 B2 10/2003 Manghera
6,648,155 B1 11/2003 Wang
6,659,294 B1 12/2003 Simard
6,669,037 B1 12/2003 Ahn
6,698,705 B2 3/2004 Toghanian
6,702,126 B2 3/2004 Park
2002/0046982 A1 * 4/2002 Guizzardi ..... 211/187
2003/0000905 A1 1/2003 Zidek
2003/0189021 A1 10/2003 Engel
2004/0020878 A1 2/2004 Boron
2005/0061760 A1 * 3/2005 Briosi ..... 211/187

* cited by examiner

SYSTEMS AND METHODS FOR DISPLAYING ARTICLES

BACKGROUND OF THE INVENTION

The present invention relates generally to display racks, and more particularly to customizable systems and methods for displaying articles.

Various display systems are available, however, many of such systems can be used on only a limited implementation reducing the usefulness of such systems. Hence, there exists a need in the art for advanced systems and methods for displaying articles.

BRIEF SUMMARY OF THE INVENTION

The present invention relates generally to display racks, and more particularly to customizable systems and methods for displaying articles. In some cases, racks in accordance with the present invention include a variety of elements that can be assembled into a number of different configurations. For example, the rack can include one or more rack systems that each include a base and one or more display support structures. These rack systems can be designed to accept bracketed shelves into slots, and/or hangers into a backing incorporated into the support structures of the rack systems.

One embodiment of the present invention provides a modifiable display rack that includes two rack systems. Each of the rack systems include a display support with a plurality of shelving slots and supported by a base. The modifiable rack further includes two or more shelves that are attachable to the respective rack systems via the shelving slots, and a mating shelf. One or more of the shelves includes a mating feature along a side of the respective shelves that is attachable to a mating feature of the mating shelf. In one particular case, the mating shelf includes a male connector extending from the side thereof, while the other shelves include a slot into which the male connector fits. When used, the mating shelf can extend the length of a particular shelf, and/or connect two shelves coupled to respective ones of the rack systems to make one long shelf. In some instances, each base of the respective rack systems includes four corners with corner protectors mounted on two adjacent corners. The bases are brought together with the corners not covered by corner protectors touching each other, and mounting hardware holds the bases in the joined orientation.

Another embodiment of the present invention provides a customizable display rack. The customizable display rack includes two rack systems each including a display support member and a base. The display support members include an outer perimeter having a plurality of shelving slots and a mesh backing disposed in an inner area. Further, the display support members include a removable graphical presentation disposed in the inner area of the display support member via a slot extending within the respective display support member. The display rack further includes two or more removable shelves that can be attached via the slots in the respective display members. These shelves include mating features that can accept a corresponding mating feature of a mating shelf in such a way that the length of the overall shelf, including the mating shelf, is extended.

In some embodiments of the invention, the inner mesh is supported by an inner slot disposed in a particular display support. In one particular embodiment, the slot is an opening in the top of the display member extending across the inner area and partially into the outer perimeter. This slot extends the length of the outer perimeter allowing for a mesh backing or inner mesh to be inserted into the inner slot and thus cover the inner area defined by the outer perimeter of the display structure.

Additional embodiments of the present invention provide display kits. These display kits include at least one display support member, at least one mesh backing, at least one shelf that is capable of attachment to the display support member, at least one hanger, and/or a set of printed instructions that can, for example, describe forming a display rack using the display kit. In some cases, the kit includes the display support member and the base assembled to create a rack system. Further, in some cases, the display kits can include two or more of the rack systems each assembled to be compatible with other of the rack systems.

In one particular case, two rack systems are included in the display kit, and each of the rack systems includes corner protectors mounted on two adjacent base corners of the rack systems. The rack systems can be joined such that the corner protectors are on the outside corners of the joined base. In some cases, the display kit further includes hardware for attaching the bases of the two rack systems. Further, in some cases, mating shelves are included in the display kit.

Yet additional embodiments of the present invention provide methods for displaying articles. Such methods include providing two display support members that each include an inner area with an inner mesh, and at least one of which includes an outer perimeter with a plurality of shelving slots. A base is also provided onto which the first and second display support members can be mounted. A plurality of shelves are provided that are capable of attaching to the plurality of shelving slots. Further, a plurality of hangers are provided that are capable of attachment to the inner mesh of the display support members.

This summary provides only a general outline of some embodiments according to the present invention. Many other objects, features, advantages and other embodiments of the present invention will become more fully apparent from the following detailed description, the appended claims and the accompanying drawings.

BRIEF DESCRIPTION OF THE DRAWINGS

A further understanding of the various embodiments of the present invention may be realized by reference to the figures which are described in remaining portions of the specification. In the figures, like reference numerals are used throughout several to refer to similar components. In some instances, a sub-label consisting of a lower case letter is associated with a reference numeral to denote one of multiple similar components. When reference is made to a reference numeral without specification to an existing sub-label, it is intended to refer to all such multiple similar components.

DETAILED DESCRIPTION OF THE INVENTION

The present invention relates generally to display racks, and more particularly to customizable systems and methods for displaying articles. In some cases, racks in accordance with the present invention include a variety of elements that can be assembled into a number of different configurations. For example, the rack can include one or more rack systems that each include a base and one or more display support structures. These rack systems can be designed to accept bracketed shelves into slots, and/or hangers into a backing incorporated into the support structures of the rack systems.

Figure 1:
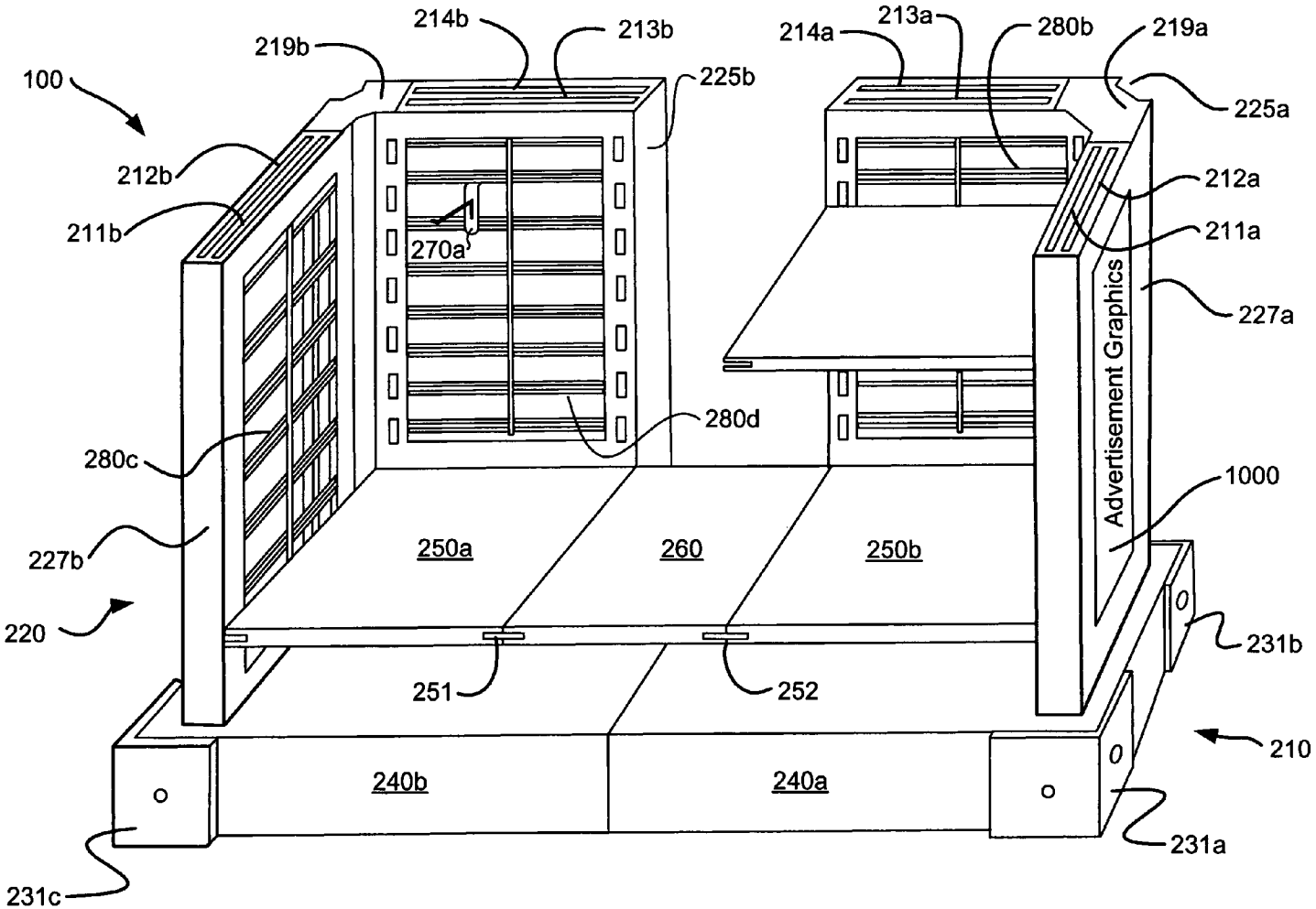
FIG. 1 illustrates two rack systems assembled as a single display rack in one of many configurations possible in accordance with various embodiments of the present invention.

Turning to FIG. 1, a display rack 100 comprised of two rack systems 210, 220 is illustrated. As illustrated, rack system 210 is joined with rack system 220. As illustrated, rack system 210 includes display supports 225*a*, 227*a* that are supported by a base 240*a*. However, as more fully described below, a rack systems can include one or more display supports 225, 227 associated with a base. For example, in one embodiment, only a single display support is used extending from a base (illustrated in FIG. 5), while in other embodiments, two display supports extend approximately perpendicular from each other up from the base (illustrated in FIG. 4). In yet other embodiments, three display supports could be supported by a base (not shown). Similarly, rack system 220 includes display supports 225*b*, 227*b* that are supported by base 240*b*.

As illustrated, display rack 100 is configured with two bracketed shelves 250*b*, 250*c* attached to rack system 210 and one bracketed shelf 250*a* is attached to rack system 220. In addition, a mating shelf 260 is placed between the two bracketed shelves 250*a*, 250*b* to make one continuous shelf. Also, two hangers 270 are installed into a mesh backing 280*d* that is part of rack system 220. The interaction of the shelves and hangers with the rack systems and each other is described in more detail below.

As will be appreciated from the disclosure provided herein, the configuration of display rack 100 is one of a large number of configurations that are possible in accordance with embodiments of the present invention. In particular, display rack 100 is comprised of a number of components described below in detail that can be assembled into a variety of configurations. As just some examples, a rack in accordance with the present invention can include only one rack system, two rack systems, or three or more rack systems. In particular, display rack 100 can be extended to include two additional rack systems arranged to the back of that illustrated to make a display rack accessible from both the front and back sides. Further, display rack 100 can be extended to place a rack system including a single display support placed between rack system 210 and rack system 220 to extend the length thereof. Yet further, a display rack can be comprised of a number of rack systems with only a single display support that are joined such that the assemble display rack is open on the end(s). Also, the shelves (including mating and bracketed shelves) and hangers can be arranged in a large number of configurations to meet a particular display need. Based on the disclosure provided herein, one of ordinary skill in the art will recognize a variety of display rack configurations that are possible in accordance with embodiments of the present invention.

Figure 2:
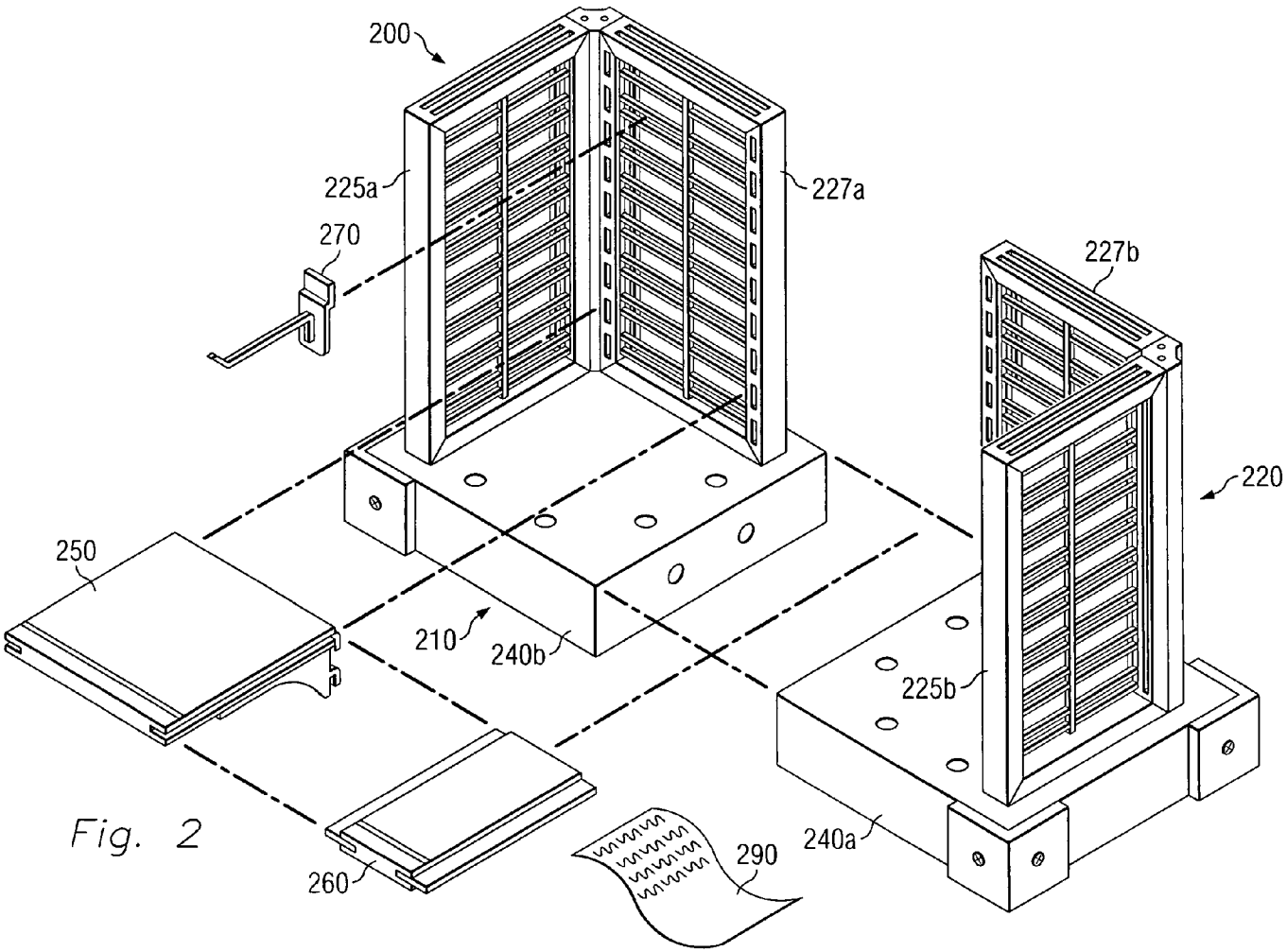
FIG. 2 illustrates a display rack kit including two assembled display rack systems in accordance with some embodiments of the present invention.

Turning to FIG. 2, a rack kit 200 illustrates a grouping of rack elements that can be assembled to create a variety of display racks including, but not limited to, display rack 100. Rack kit 200 includes rack system 210, rack system 220, one or more hangers 270, one or more mating shelves 260, one or more bracketed shelves 250, and/or a set of printed instructions 290. Printed instructions 290 can include examples of various configurations achievable using the elements included in rack kit 200, and instructions for assembling the elements. Also, in some cases, rack kit 200 includes assembly hardware (not illustrated) for attaching rack systems 210, 220.

Figure 3:
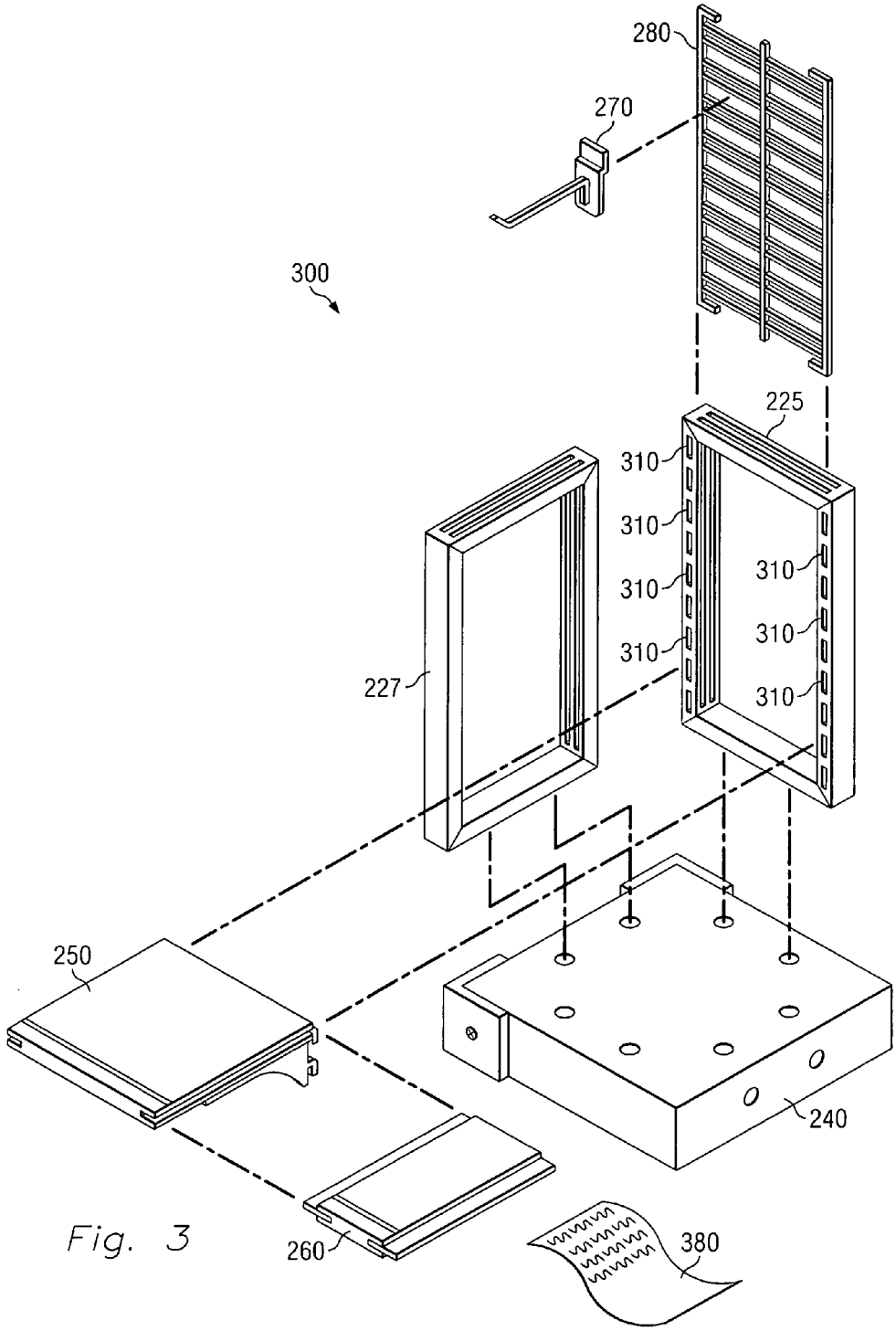
FIG. 3 illustrates another display rack kit in accordance with other embodiments of the present invention.

Turning to FIG. 3, a rack kit 300 illustrates another grouping of rack elements that can be assembled to create a variety of display racks including, but not limited to, display rack 100. Rack kit 300 includes one or more bases 240, one or more display supports 225 including shelving slots 310, one or more mesh backings 280, one or more display supports 227 without shelving slots, one or more hangers 270, one or more mating shelves 260, one or more bracketed shelves 250, and/or a set of printed instructions 350. Printed instructions 350 can include examples of various configurations achievable using the elements included in rack kit 200, and instructions for assembling the elements including, but not limited to, for associating mesh backing(s) 280 with display supports 225, 227, and/or associating shelves (bracketed and mating) with an assembled rack to achieve a variety of configurations. Also, in some cases, rack kit 300 200 includes assembly hardware (not illustrated) for attaching display supports 225, 227 to base(s) 240, and/or for attaching bases 240 together.

Figure 4:
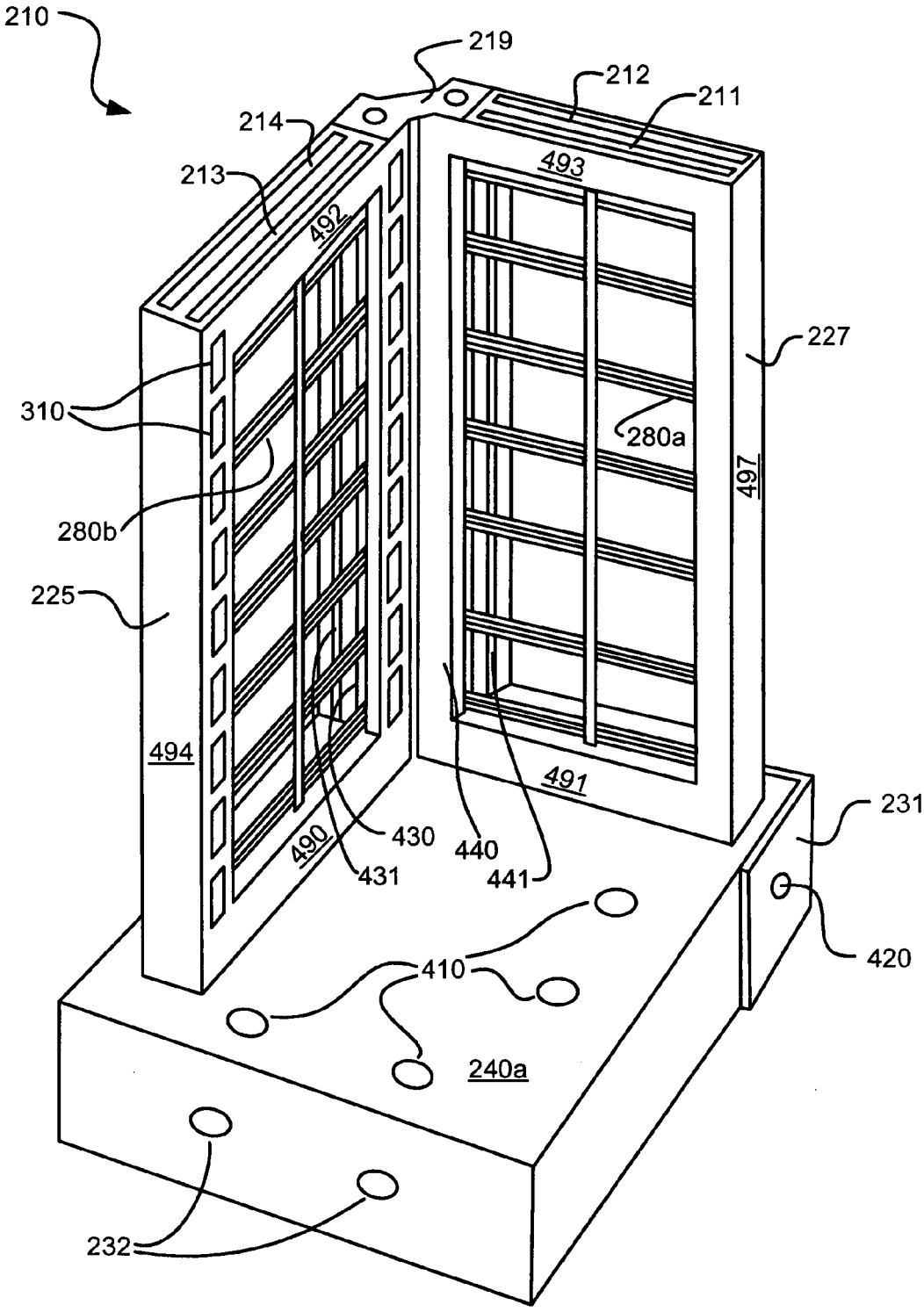
FIG. 4 illustrates a display rack system in accordance with some embodiments of the present invention.

Turning to FIG. 4, a detailed illustration of rack system 210 is provided. As illustrated, rack system 210 includes base 240, and display supports 225, 227 mounted to base 240 and attached at the top with a bracket 219. Display support 225 includes a number of shelving slots 310 that support bracketed shelves as more fully described below. In addition, display support 225 includes an outer perimeter 490. Two slots 213, 214 extend through an upper portion 492 of outer perimeter 490. Slots 213, 214 also extend along side portions 494, 495 of outer perimeter 490 and are labeled as side slots 430, 431, respectively. Mesh backing 280*b* is inserted into one of slots 213, 214 where it is held in place in an inner area defined by outer perimeter 490. As set forth in greater detail below, a graphical presentation 1000 (shown in FIGS. 1 and 8) can be inserted into one of slots 213, 214.

Similarly, display support 227 includes an outer perimeter 491. Two slots 211, 212 extend through an upper portion 493 of outer perimeter 491. Slots 211, 212 also extend along side portions 496, 497 of outer perimeter 491 and are labeled as side slots 440, 441, respectively. Mesh backing 280*a* is inserted into one of slots 211, 212 where it is held in place in an inner area defined by outer perimeter 491. Again, as set forth in greater detail below, a graphical presentation (not shown) 1000 can be inserted into one of slots 211, 212. In one particular embodiment, both mesh backing 280 and display supports 225, 227 are made of metal. Such metal can include, but is not limited to, stainless steel, steel, and/or aluminum.

Figure 6:
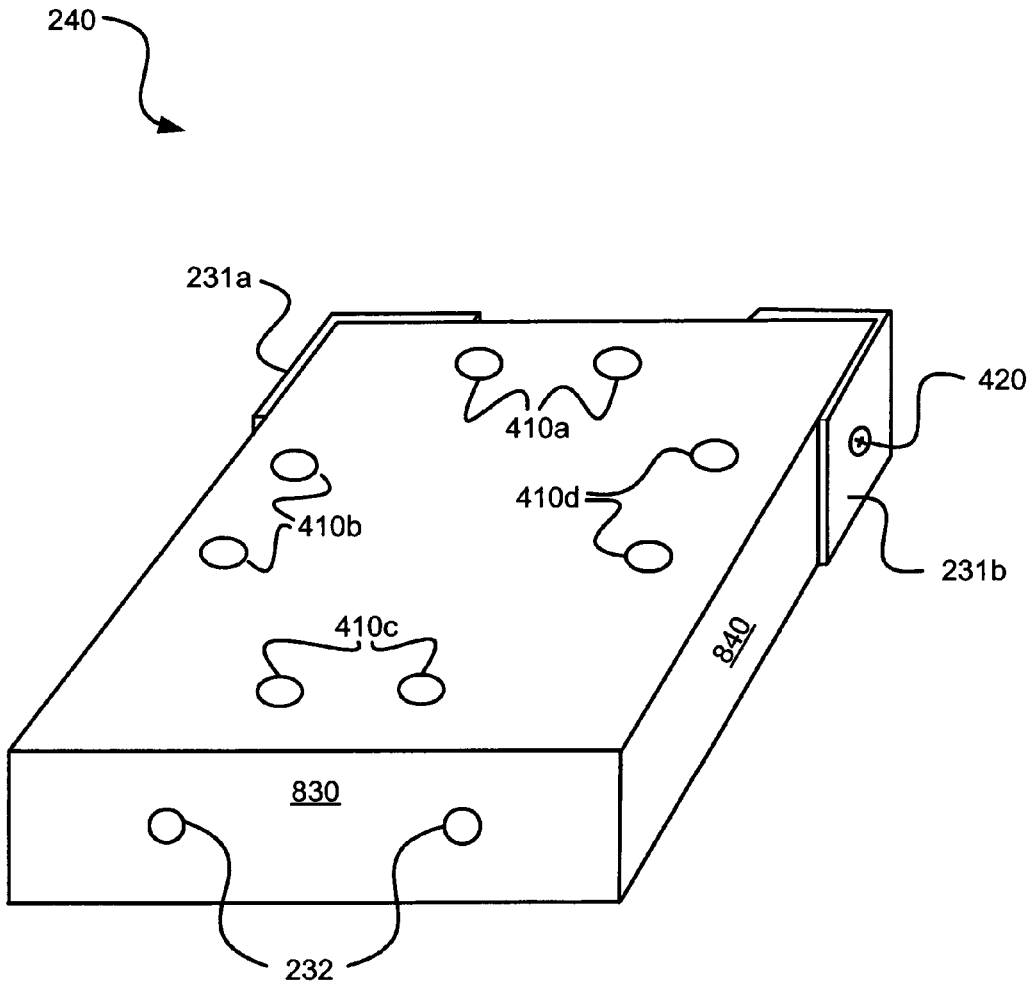
FIG. 6 illustrates a base of the display rack system of FIG. 4.

Base 240 includes two side mounting holes 232. Mounting holes 232 are operable to receive mounting hardware (not shown) to attach another base to base 240. Further, base 240 includes eight display support mounting holes 410 arranged two per side with four of the holes 410 disposed under the illustrated display supports 225, 227. Holes 410 that are used to secure display supports 225, 227 can have a bolt or other mounting hardware passed through the hole an into the respective display support. Other holes 410 that are not used to secure a display support can be filled with a decorative plug, or may not exist at all. In one particular embodiment, base 240 is made of wood. FIG. 6 below illustrates base 240 without the associated display structures such that all holes 410 are visible.

Figure 5:
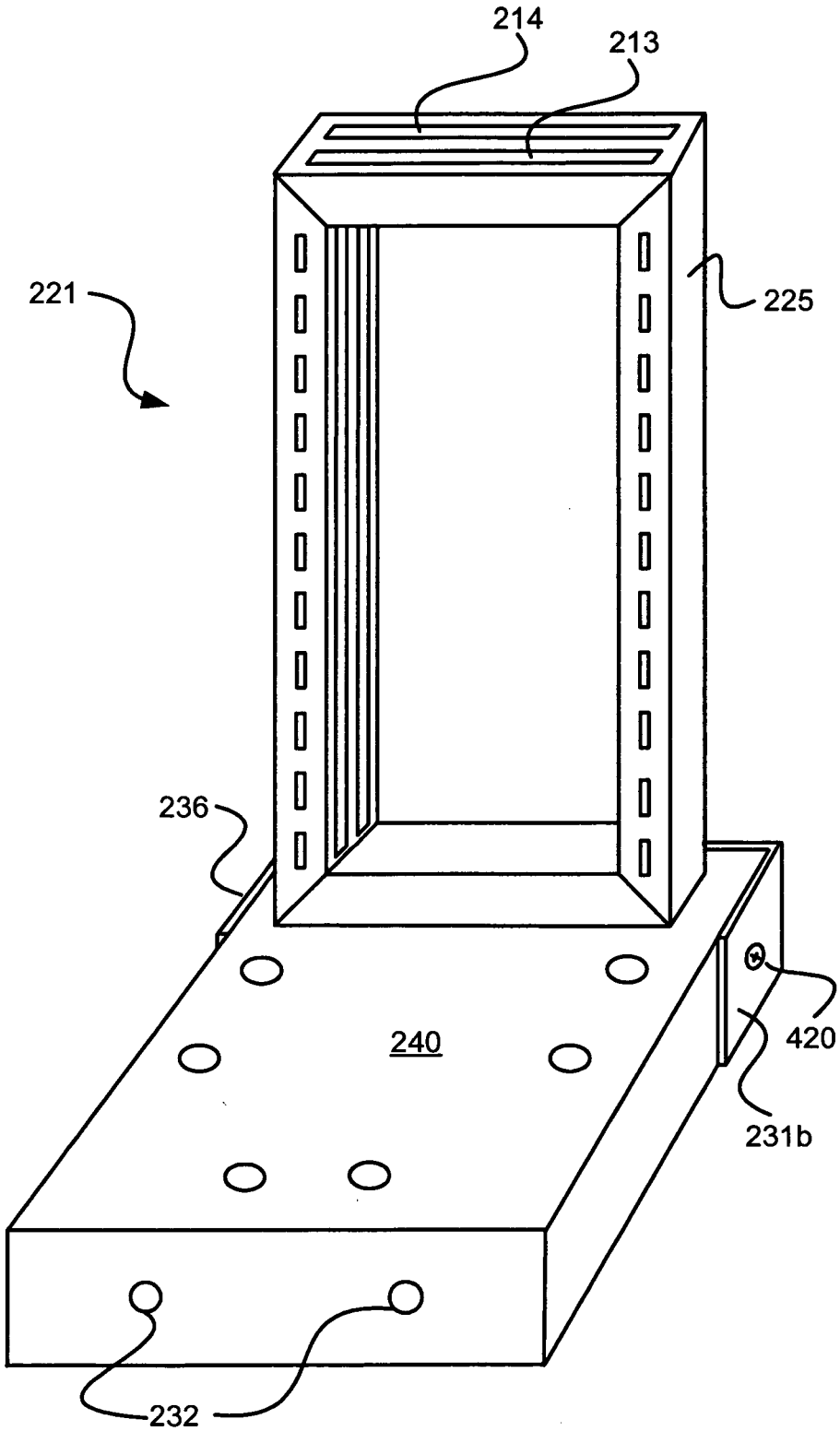
FIG. 5 illustrates a single display support rack system in accordance with various embodiments of the present invention.

Two corners of base 240 can be covered by a corner protector 231 which is attached to base 240 by a fastener 420. In one particular embodiment, corner protector 231 is made of the same metal as display supports 225, 227, while in other embodiments it is made of another metal or wood. Turning to FIG. 5, a rack system 221 with a single display support in accordance with various embodiments of the present invention is depicted. As illustrated, rack system 221 is similar to rack systems 210, 220, but without the second display support. Further, display support 225 is illustrated without a removable mesh backing 280 or graphical presentation 1000. Turning to FIG. 6, a detailed depiction of base 240 is illustrated without holes 410 obstructed by display structures 225, 227.

Figure 7:
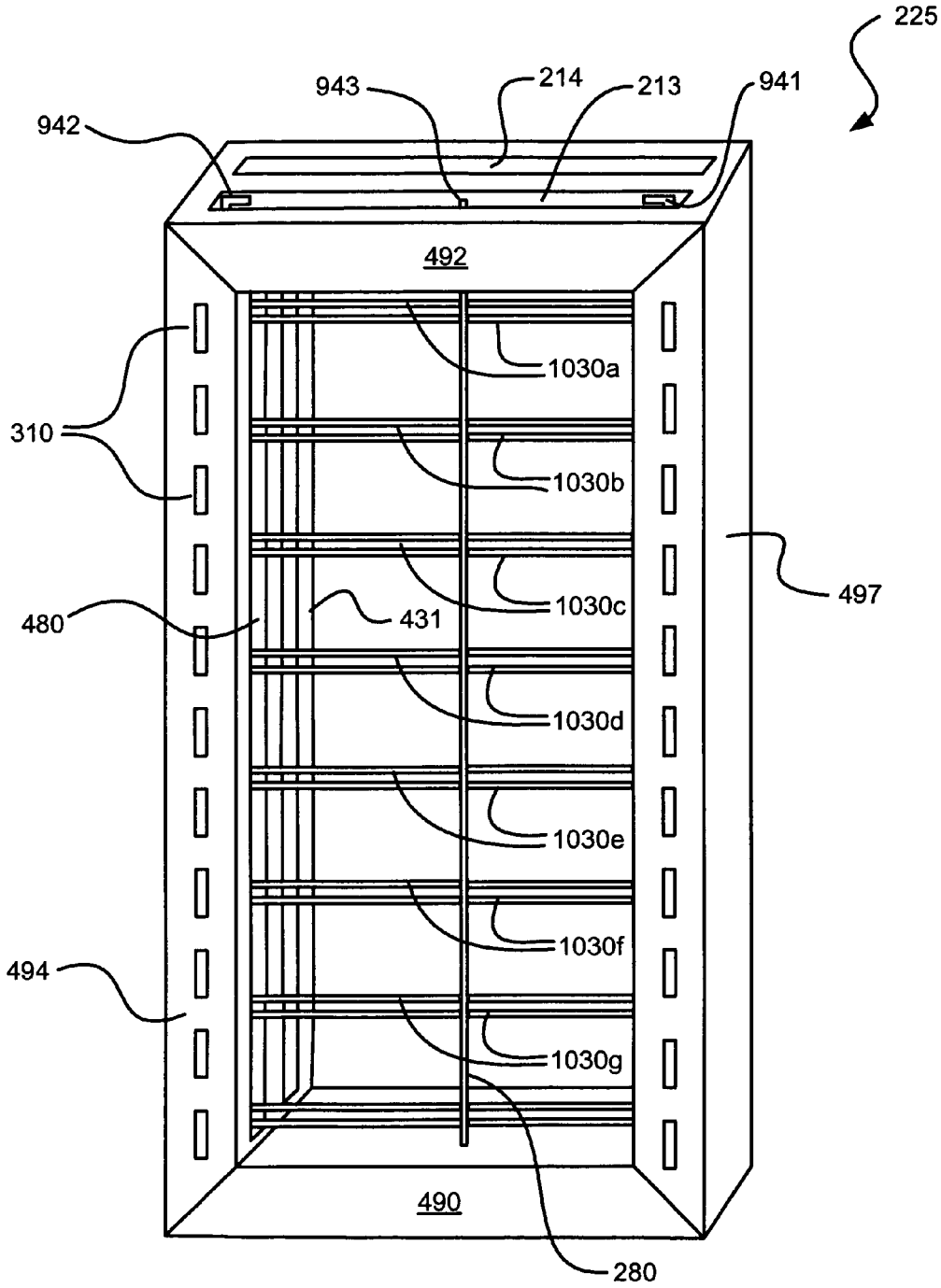
FIG. 7 illustrates a display support structure in accordance with various embodiments of the present invention.

Turning to FIG. 7, a detailed illustration of display structure 225 is provided. Display structure 225 includes a number of shelving slots 310 that support bracketed shelves. In addition, display support 225 includes an outer perimeter 490. Two slots 213, 214 extend through an upper portion 492 of outer perimeter 490. Slots 213, 214 also extend along side portions 494, 495 of outer perimeter 490 and are labeled as side slots 430, 431, respectively. Mesh backing 280 is inserted into one of slots 213, 214 where it is held in place in an inner area defined by outer perimeter 490. Mesh backing 280 includes a number of horizontal cross bar pairs 1030, a vertical center bar 943 extending up through slot 213, and vertical side bars 941, 942 extending through slot 213. FIG. 8B illustrates an embodiment of mesh backing 280 dissociated from a display structure.

In one particular embodiment, mesh backing 280 is attached in a non-removable way to the associated display support, while in other embodiments, it is removable via one of the slots. Further, the spacing of horizontal pairs 1030 is designed to support particular hangers, and thus different spacing and/or designs can be selected to support different hanger requirements. Thus, for example, a mesh backing with a solid surface perforated with holes to allow insertion of hangers could be used in accordance with the present invention. Accordingly, it should be recognized that the term "mesh backing" is used in its broadest sense to mean any backing with structures or openings supporting one or more hangers. Based on the disclosure provided herein, one of ordinary skill in the art will recognize a myriad of other designs and/or configurations that can be used for mesh backing 280.

Figure 8A:
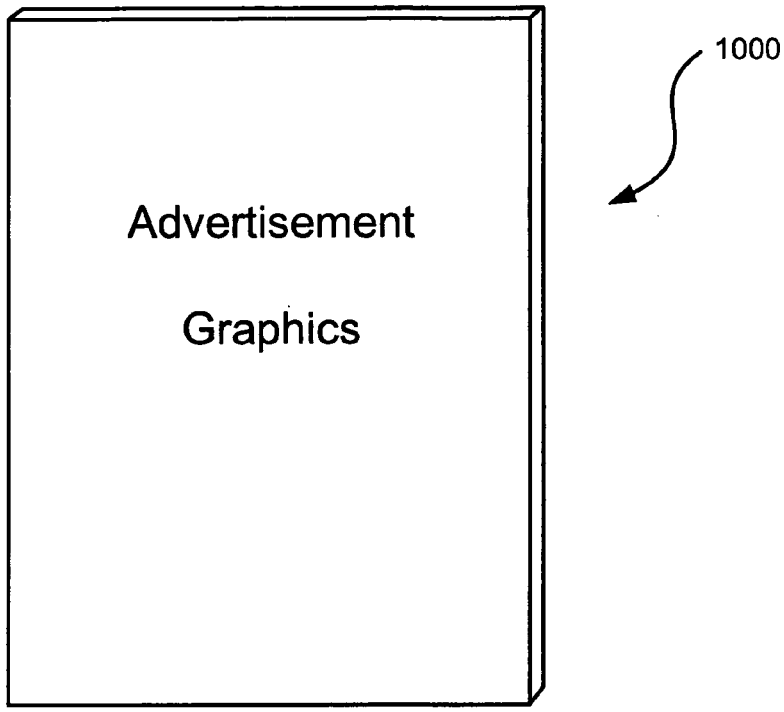
FIG. 8 illustrate a mesh backing and a graphical presentation in accordance with some embodiments of the present invention.
Figure 8B:
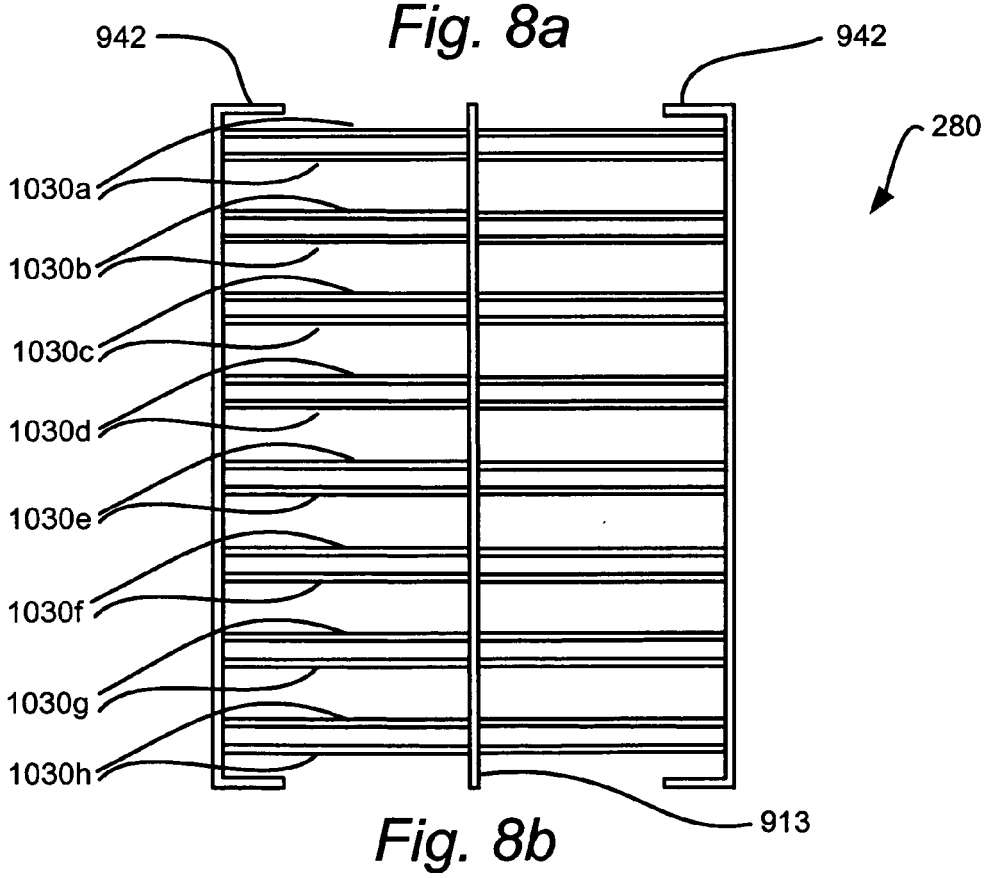

Turning to FIG. 8A, a detailed illustration of a graphical presentation 1000 in accordance with some embodiments of the present invention is illustrated. Graphical presentation 1000 can be made of any number of materials and is cut to a size that will fit in one of slots 213, 214, 211, 212. Graphical presentation 1000 allows for advertisements or other graphics to differentiate a display rack. Because graphical presentation 1000 is removable, it can be replaced with another graphical presentation when, for example, the articles on a display rack have been reduced in price or to advertise a new type of article. Thus, some embodiments of the present invention provide for increased flexibility in differentiating the display racks.

Figure 9A:
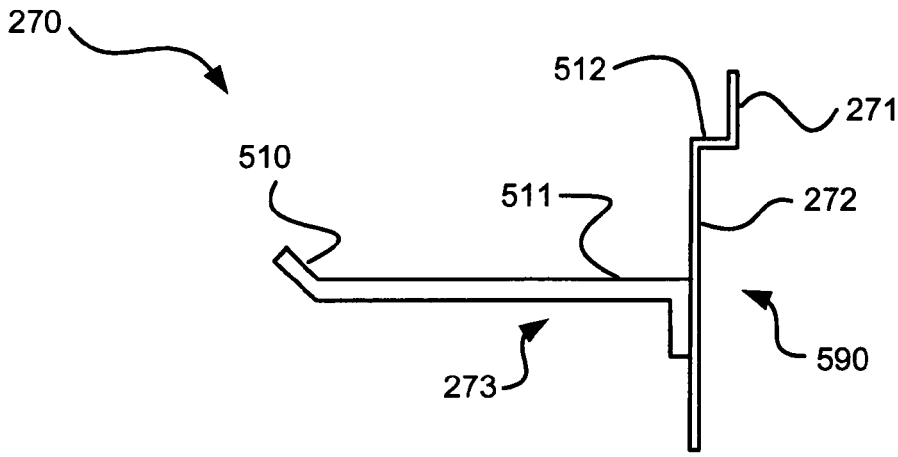
FIG. 9 illustrate a hanger useful in relation to some embodiments of the present invention.
Figure 9B:
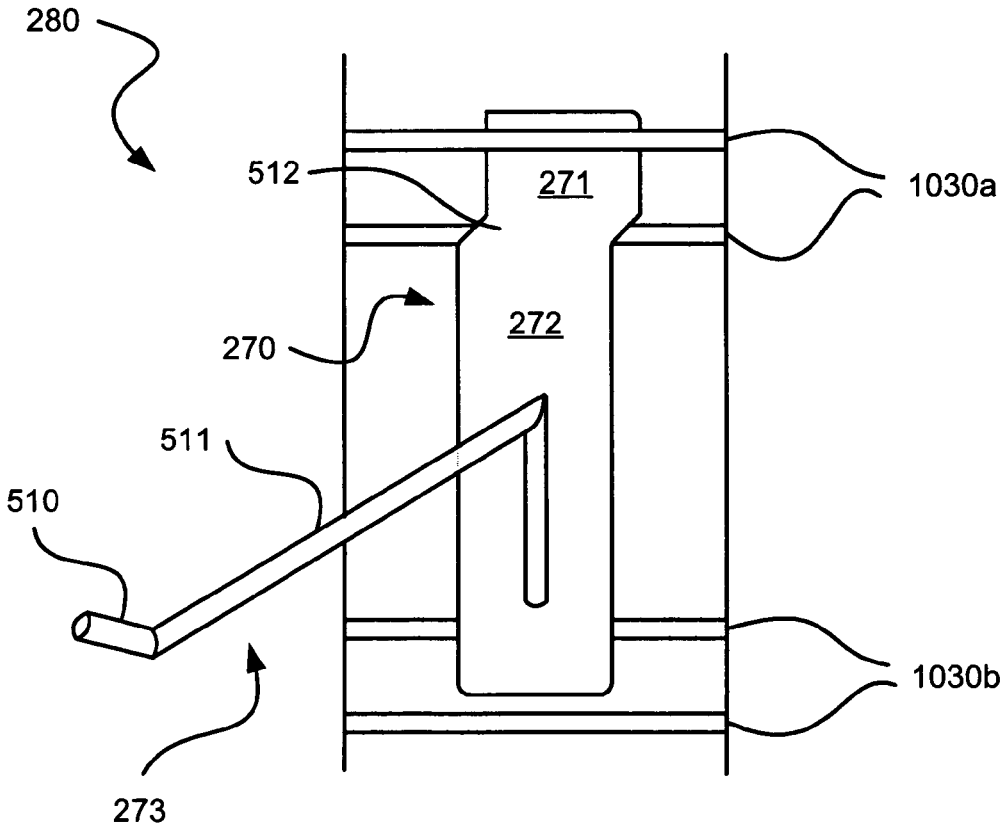

Turning to FIG. 9A, hanger 270 is illustrated. Hanger 270 includes a connection portion 590 that includes a vertical support 272, a horizontal extension 512, and a vertical catch 271. Further, hanger 270 includes a hanger portion 273 with an extension 511 that extends away from connection portion 590 and is turned up at end 510. FIG. 9B illustrates the interaction of hanger 270 with a portion of mesh backing 280. In particular, mesh backing 280 includes pairs of horizontal bars 1030. Vertical catch 271 touches the back side of one of the horizontal bars 1030*a*, and horizontal extension 512 rests on the other horizontal bar 1030*a* of the pair. vertical support 272 extends in front of horizontal bars 1030 and rests against at least one of horizontal bars 1030*b*. In this potions, hanger portion 273 extends away from mesh backing 280, and is capable of supporting an article suspended therefrom.

Figure 10A:
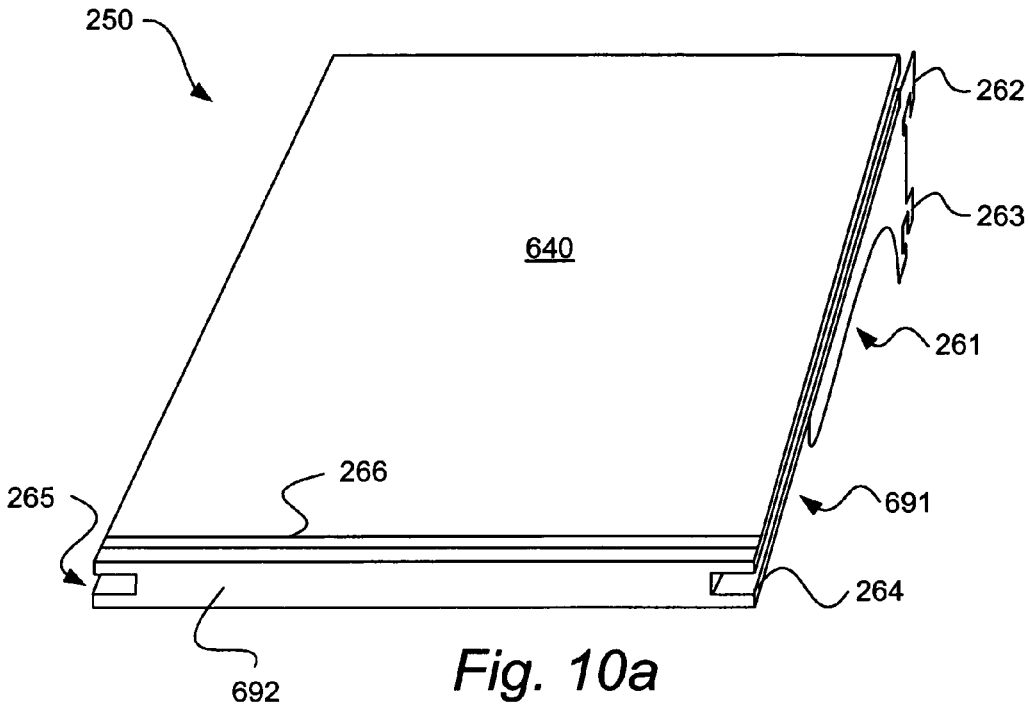
FIG. 10 illustrate a bracketed shelf in accordance with some embodiments of the present invention.
Figure 10B:
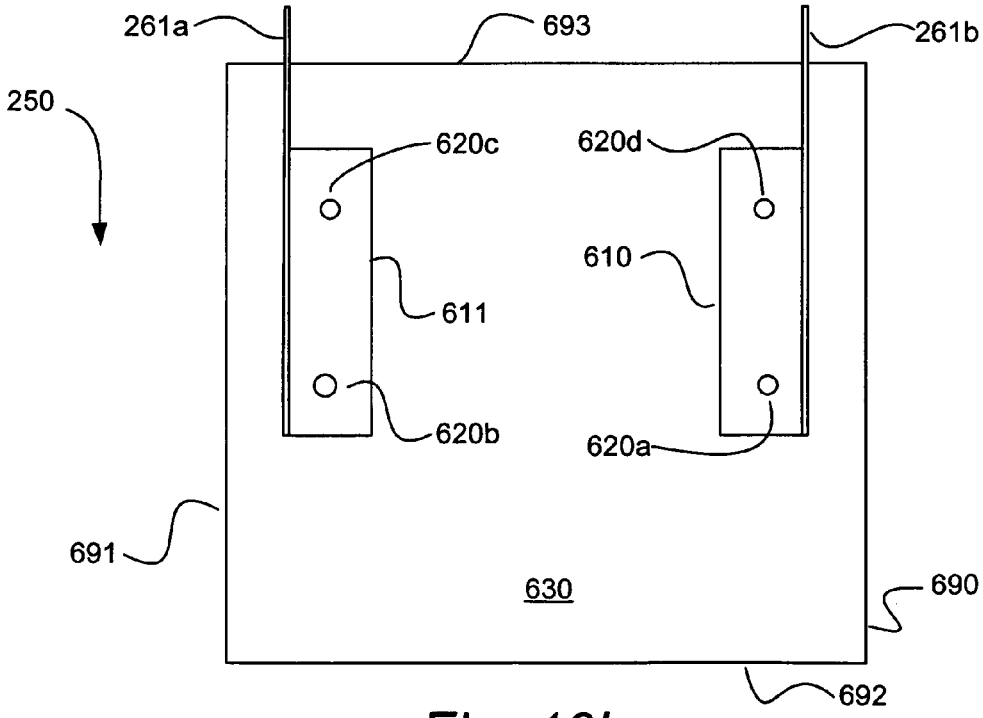

Turning to FIG. 10, a detailed drawing of bracketed shelf 250 is illustrated. Bracketed shelf 250 includes an upper surface 640, a lower surface 630, side surfaces 690, 691, a front surface 692, and a back surface 693. A mating feature 264 extends along side surface 691, and another mating feature 265 extends along side surface 690. In one embodiment, mating features 264, 265 are slots extending along the respective sides. Other mating features, both male and female, can also be used in accordance with embodiments of the present invention. For example, such alternative mating features can attach to bracketed shelf 250, or can be integral with bracketed shelf 250. The mating features can be used to mate with other shelves, such as mating shelf 260 to extend the length of the shelf. In some embodiments, mating features are placed on both side surfaces 690, 691 of bracketed shelf 250. In other embodiments, a mating feature is placed only on one of sides 690, 691, and in yet other embodiments, a mating feature is placed on all sides 690, 691, 692, 693.

Bracketed shelf 250 also includes brackets 261 that are attached to bottom side 630 via by fasteners 620 passed through mounting portions 610, 611 or the respective brackets 261. Each bracket 261 includes an attachment portion 263 that includes one or more attachment points 262, 263 that can be inserted into shelving slots 310. Bracketed shelf 250 can also include a decorative slot 266.

Figure 10C:
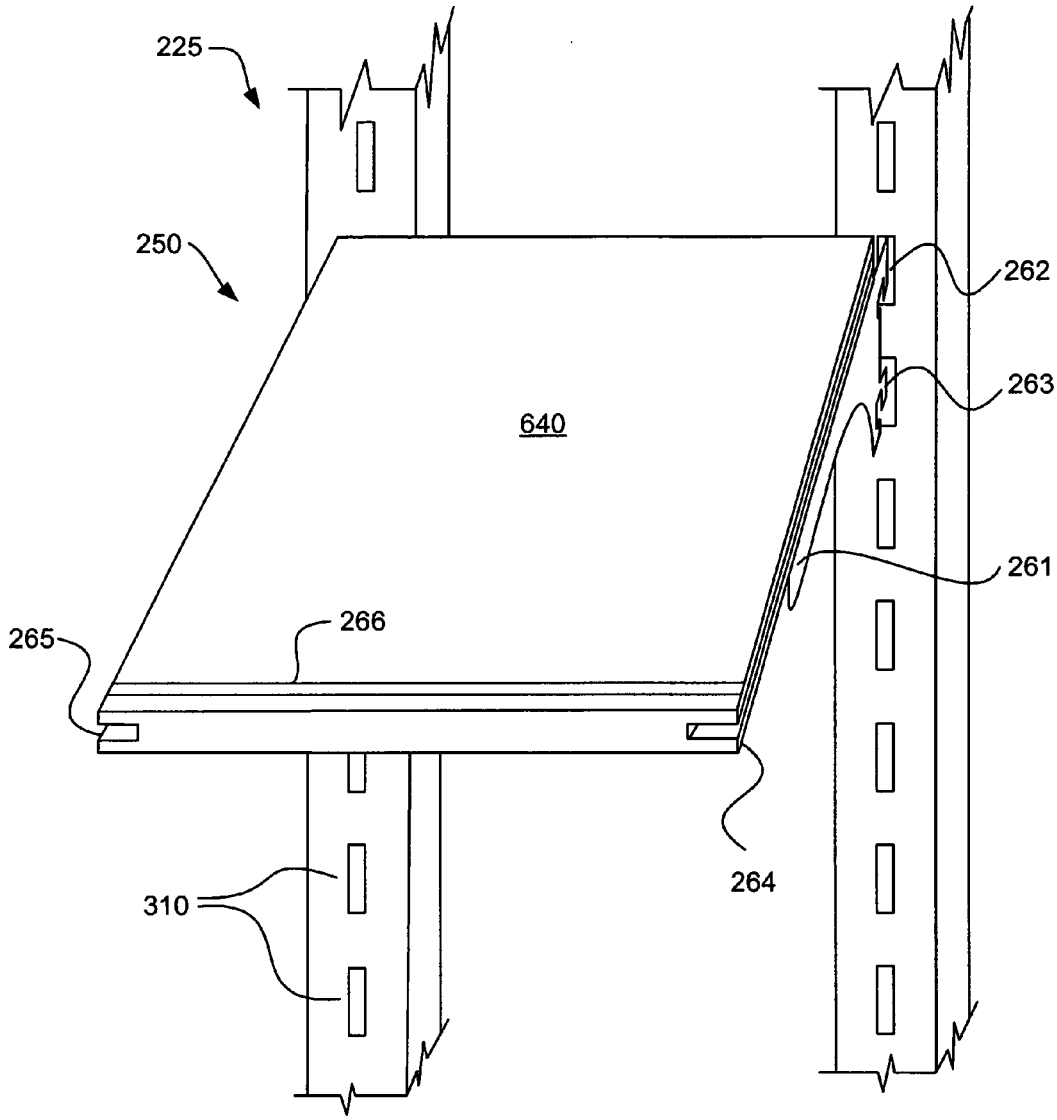

Turning to FIG. 10C, bracketed shelf 250 is shown in relation to a portion of display structure 225 to which it is joined. In particular, attachment points 262, 263 are inserted into adjacent shelving slots 310 on the outer perimeter of display structure 225. In this position, bracketed shelf 250 extends out from display structure 225 and is capable of supporting an article thereon. In one particular embodiment, brackets 261 are made of metal, while the shelf portion of bracketed shelf 250 is made of wood.

Figure 11:
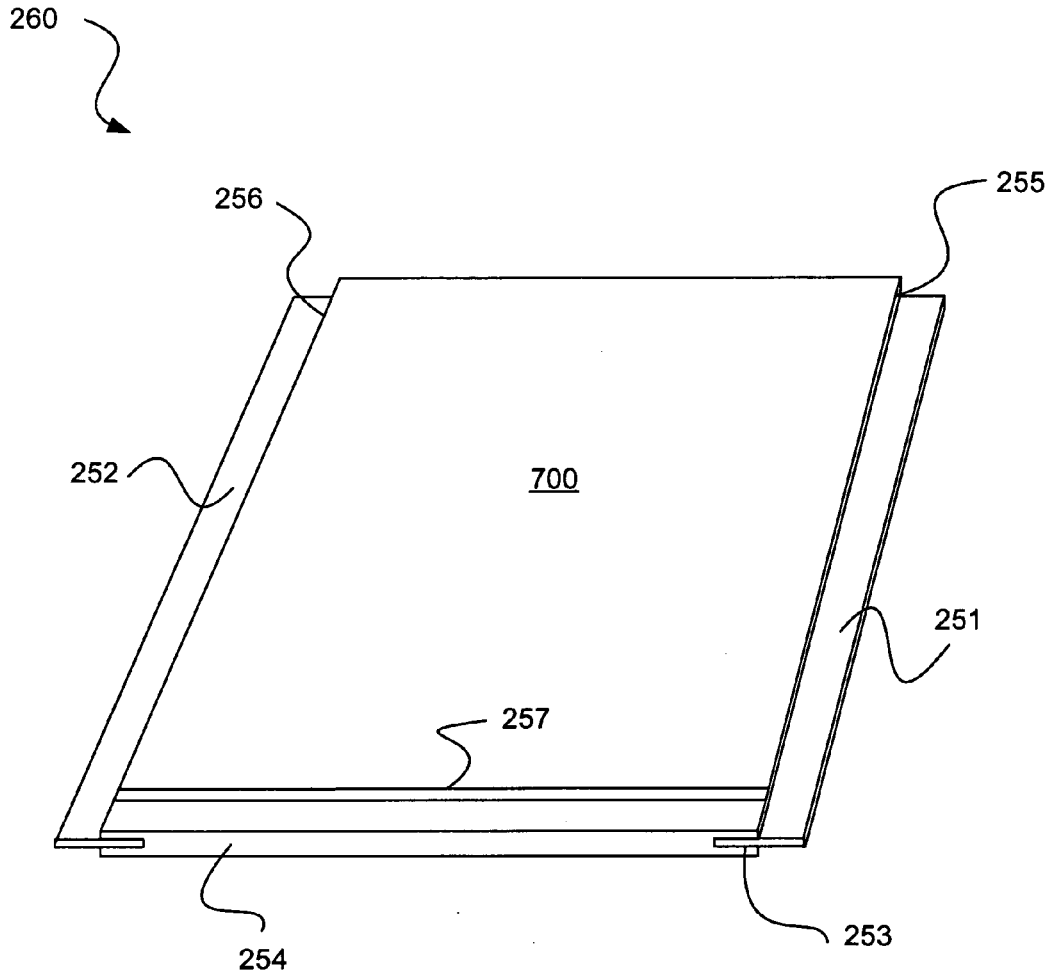
FIG. 11 illustrates a mating shelf in accordance with various embodiments of the present invention.

Turning to FIG. 11, mating shelf 260 is illustrated. Mating shelf 260 includes an upper surface 700, a lower surface (not shown), and two side surfaces 255, 256. In addition, mating features 251, 252 are associated with respective sides 255, 256 of mating shelf 260. In the illustrated embodiment, mating features 251, 252 are metal protrusions inserted into respective slots 253, 254. Further, mating shelf 260 includes a decorative trench 257. In one particular embodiment, mating features 251, 252 are metal, while the shelf portion of mating shelf 260 is formed of wood. Based on the disclosure provided herein, one of ordinary skill in the art will recognize a number of other mating features that can be used in relation to mating shelf 260. Further, in some embodiments, the mating features may extend from only one side of mating shelf 260, while in other embodiments, the mating elements may extend from two or more sides.

In conclusion, the present invention provides novel systems, methods and arrangements for display racks. It should be recognized that many configurations are possible in accordance with the present invention, and thus, while detailed descriptions of one or more embodiments of the invention have been given above, various alternatives, modifications, and equivalents will be apparent to those skilled in the art without varying from the spirit of the invention. Therefore, the above description should not be taken as limiting the scope of the invention, which is defined by the appended claims.

What is claimed is:

1. A modifiable display rack, the display rack comprising:

a first rack system, wherein the first rack system includes at least two first display support members supported by one of said first, and wherein a first display support members includes a first plurality of shelving slots;

a second rack system, wherein the second rack system includes at least two second display support members supported by a second base, and wherein one of said second display support members includes a second plurality of shelving slots;

a first shelf capable of coupling to a subset of the first plurality of shelving slots, wherein the first shelf includes a top, a bottom, and at least three sides, and wherein the first shelf includes a first mating feature along at least one of the sides, and wherein at least two of the sides couple to the at least two first display support members;

a second shelf capable of coupling to a subset of the second plurality of shelving slots, wherein the second shelf includes a top, a bottom, and at least three sides, and wherein the second shelf includes a second mating feature along at least one of the sides, and wherein at least two of the sides couple to the at least two second display support members; and a mating shelf comprises a front surface, a back surface, and two side surfaces that do not adjoin to the at least two first display support members or the at least two second display support members, wherein the mating shelf is capable of joining with the first mating feature and the second mating feature to extend at least one of the first shelf and the second shelf without coupling to at least one of the subset of the first plurality of shelving slots and the subset of the second plurality of shelving slots.

2. The modifiable display rack of claim 1, wherein the first mating feature includes a first female connector, wherein the second mating feature includes a second female connector; wherein the mating shelf includes a top, a bottom, a front side, a back side, a first lateral side, and a second lateral side, and wherein the first lateral side includes a first male connector and the second lateral side includes a second male connector; wherein the first male connector is capable of mating with the first female connector; and wherein the second male connector is capable of mating with the second female connector.

3. The modifiable display rack of claim 1, wherein the first mating feature includes a female connector, wherein the mating shelf includes a top, a bottom, a front side, a back side, a first lateral side, and a second lateral side, and wherein the first lateral side includes a male connector; and wherein the male connector is capable of mating with the female connector.

4. The modifiable display rack of claim 1, wherein the first base includes four corners; wherein a first corner protector is mounted on one of the four corners; wherein a second corner protector is mounted on an adjacent one of the other four corners; and wherein the first base and the second base are coupled together at a side that does not include the first corner protector and the second corner protector.

* * * * *